United States Patent [19]

Lingelbach

[11] Patent Number: 4,465,275

[45] Date of Patent: Aug. 14, 1984

[54] SLIDE BOARD EXERCISE APPARATUS

[76] Inventor: Everett C. Lingelbach, 6408 7th Ave., North, St. Petersburg, Fla. 33710

[21] Appl. No.: 519,051

[22] Filed: Sep. 6, 1983

Related U.S. Application Data

[63] Continuation of Ser. No. 335,719, Dec. 30, 1981.

[51] Int. Cl.[3] ..... A63B 21/00

[52] U.S. Cl. ..... 272/134; 272/117

[58] Field of Search ..... 272/117, 144, 143, 134, 272/93, 72

[56] References Cited

U.S. PATENT DOCUMENTS

| | | | |
|---|---|---|---|
| 2,783,045 | 2/1957 | Bosch | 272/144 X |
| 3,364,747 | 1/1968 | Ebstein | 272/117 X |
| 3,866,914 | 2/1975 | Jackson | 272/117 X |
| 4,243,219 | 1/1981 | Price | 272/117 |

*Primary Examiner*—Richard J. Apley
*Assistant Examiner*—William R. Browne
*Attorney, Agent, or Firm*—Walter J. Monacelli

[57] ABSTRACT

The apparatus described herein includes a substantially rectangular and flat board having a longitudinal groove adapted to receive guide pins protruding from a disc-shaped weight resting on the upper surface of the board. The board is at an angle of about 30° to 60° with the floor or base on which the board is positioned. The raised end of the board is supported, preferably by an adjustable device, to provide the desired slant angle. Arms or straps are attached to the disc-shaped weight so that a person positioned at the raised end of the board can pull the weight upward along the surface of the board. The angle of the board allows a gravity force to be exerted on the weight, with the effect of gravity being increased by adjusting the slant of the board to a greater angle. Pulling the weight up the board and then releasing it gradually to allow its sliding back to a lower position and repeating the cycle, provides an effective exercising maneuver.

5 Claims, 8 Drawing Figures

FIG. 1
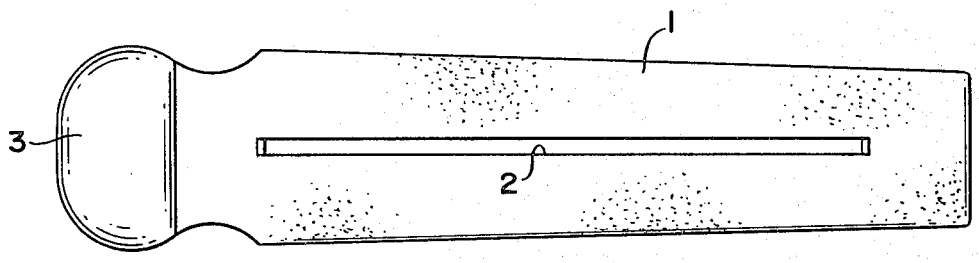
FIG. 2
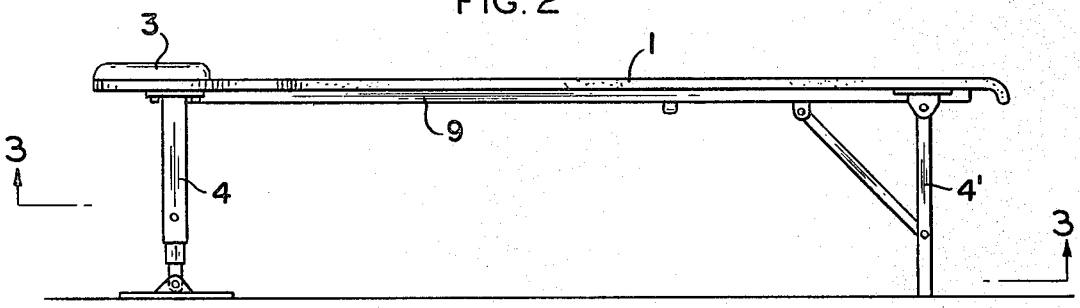
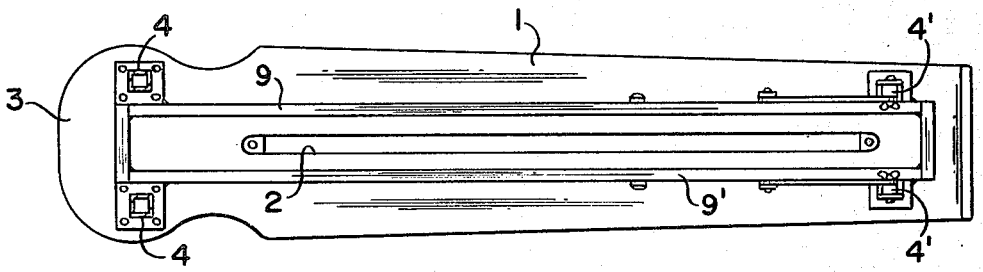
FIG. 3
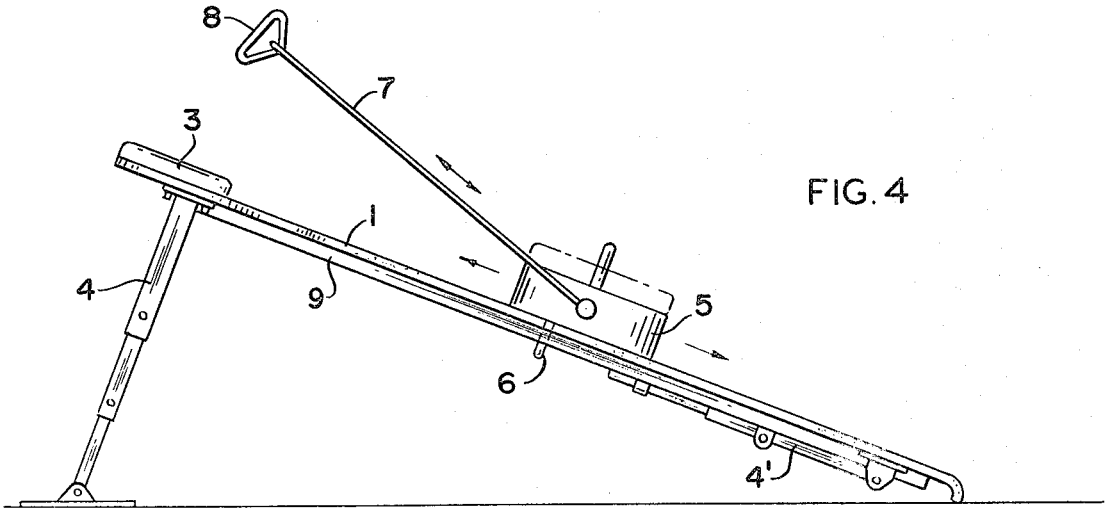
FIG. 4

FIG. 5
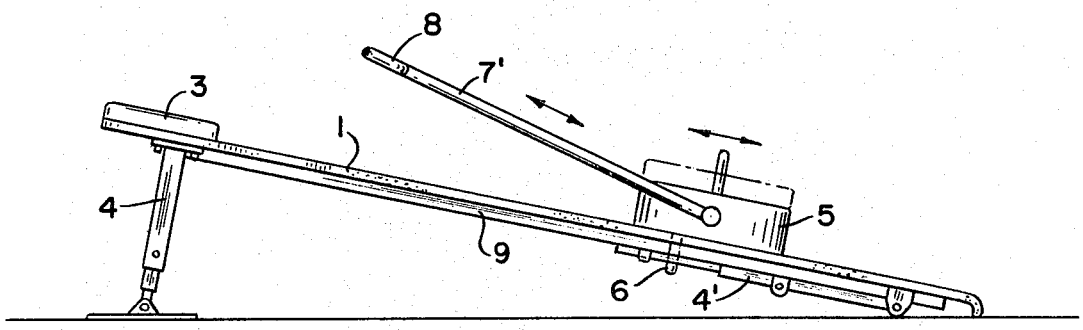
FIG. 6
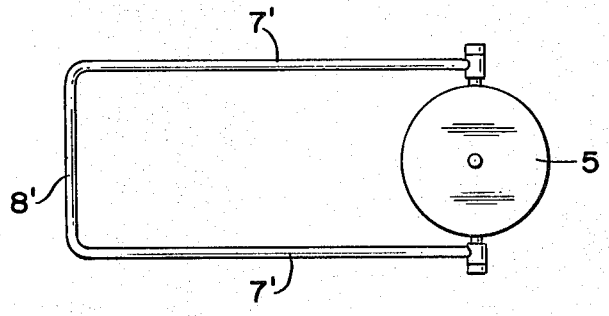
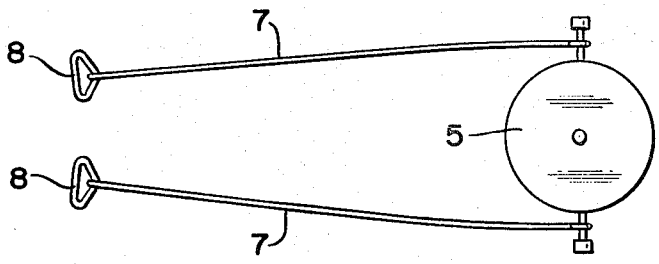
FIG. 7
FIG. 8
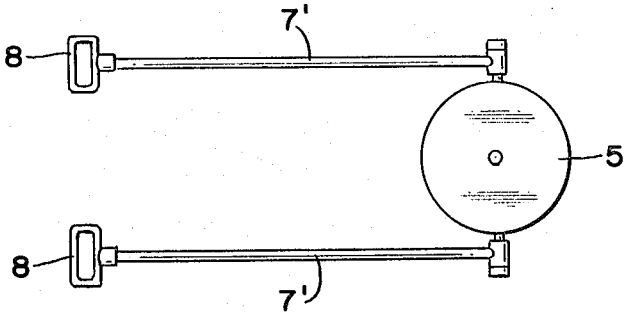

SLIDE BOARD EXERCISE APPARATUS

This is a continuation of pending application Ser. No. 335,719, filed Dec. 30, 1981 abandoned.

BACKGROUND OF THE INVENTION

1. Field of the Invention

This invention relates to an exercising device which comprises a slanted board on which a weighed disc is guided while the exerciser pulls the weight against the force of gravity. Still more specifically it relates to such a slanted board which may have the angle of slant adjusted to provide a greater or lesser pull of gravity on the weight.

2. State of the Prior Art

Various exercising devices are known in which the exerciser pulls weights against the force of gravity. Most of these operate by means of pulleys over which cables or ropes are pulled over the pulley to lift the weights such as disclosed in U.S. Pat. No. 4,257,590. Other exercising devices are designed to pull the weight of the exerciser, such as disclosed in U.S. Pat. Nos. 1,625,447; 3,586,322 and 4,101,124. These pulley devices are rather complicated and expensive.

Slanted board exercise devices have been disclosed. U.S. Pat. No. 3,866,914 shows a slanted board for use by football players, etc. to push weights upward while seated below the arrangement. Here again, this is a complicated device requiring extreme strength to operate. Another patent, U.S. Pat. No. 3,364,747 describes a device having a screw device for varying the force required to lift a weight which is positioned on a slanted board.

The foregoing devices are elaborate, complicated and expensive to manufacture.

SUMMARY OF THE INVENTION

A slant board device has been designed which is simple and inexpensive to manufacture and operate. This device comprises a substantially rectangular and flat board having a longitudinal groove or slot opening therein, a flat weight positioned above said groove and having guide pins or protrusions extending from the bottom of said weight and fitting into said groove, a supporting means adapted to support one end of this board in a raised position so that the board is slanted at an angle of about 30° to 60° with the horizontal base on which the other end of said board is rested, and arms or cables attached to opposite sides of said weight and adapted to extend to the raised end of said board. A person can exercise by pulling the weight against the force of gravity by means of the arms or cables from a lower position to a higher position on the slanted board. The force required to pull the weight can be varied by using heavier weights, or by adding to the initial weight, or by increasing the angle of the board.

The novel design of this invention may be illustrated by reference to the accompanying drawings in which:

FIG. 1 is a top view of a preferred modification of the board of this invention;

FIG. 2 is a side elevational view of the modification of FIG. 1 showing supporting means at both ends of the board;

FIG. 3 shows a bottom view of the board of FIGS. 1 and 2.

FIG. 4 shows a side elevational view of the board of FIG. 1 in a slanted position with only one supporting means in supporting position;

FIG. 5 is another side elevational view as shown in FIG. 4 except that the supporting means has been adjusted to give a lower angle of slant to the board;

FIG. 6 is a top view of a weight with arms joined to two sides thereof; and

FIGS. 7 and 8 are also top views of the weight with straps or cables joined to two sides thereof.

In these Figures, board 1 has a linear slot opening or groove 2 therein and seat 3. In FIG. 2, legs 4 support one end of the board and legs 4', when in a vertical position, support the opposite end of the board. Generally legs 4' are in a folded position to provide the slant shown in FIG. 4. In FIG. 3, legs 4' are folded so that legs 4 are the sole support means to give the board the desired slant. Supporting understructures 9 and 9' give added strength to the board.

In FIG. 4 the board is in a preferred slanting position with leg 4 shown in a telescoping modification so the length of the legs 4 can be adjusted to give longer or shorter lengths thereby giving a greater or lesser slope to board 1. In this view, weighted disc 5 is resting on board 1 and has pin 6 extending below and into groove 2 so that the disc can follow a longitudinal path on the board. Cable 7 with handle 8 is attached to the disc 5 and extends toward the raised end of the board. A person sitting on seat 3 or standing just beyond the raised end of the board can grasp handle 8 and by means of cable 7 pull the weighted disc upward on the slanted board.

FIG. 5 shows the modification of FIG. 4 with leg 4 at a shorter length thereby giving a lesser slope to the board.

FIG. 6 represents a modification of the weighted disc 5 which has rigid arms 7' attached thereto and crossbar 8' serves as a handle at the ends of arms 7' opposite from the ends attached to disc 5.

FIG. 7 shows disc and arm arrangement similar to that shown in FIG. 4.

FIG. 8 represents a disc modification similar to that in FIG. 6 except that instead of crossbar 8' to serve as a handle there are individual handles 8 attached to the end of arms 7'.

In a preferred modification of this invention the board is carpeted to reduce the friction between the weighted disc and the board thereby allowing the disc to slide more easily to a lower position.

In addition to the use of the board in the slanted position the board may be raised at both ends with the disc removed to allow the exerciser to lie on his back or on his stomach and perform exercises.

Advantageously the board may have a length of about 6 to 8 feet, a width of 15 to 20 inches and a thickness sufficient to give strength to support the weights that will be placed thereon. The supporting legs at the exercising end may range from 2 to 5 feet and are preferably adjustable to various lengths. The slot opening or groove in the board may extend to within a foot from each end of the board.

In a preferred modification the pin which extends between the disc and into the slot opening may also extend upward from the disc so that it will extend through center openings in additional discs that may be placed on the original disc so as to add increased weight to the disc.

While two arms or cables have been described and shown extending from the weighted disc, it is also contemplated that only one such arm or cable may be attached to the disc preferably with a handle at the unattached end of the arm or cable. The single arm or cable may be attached to the disc by various means such as a small ring attached to the disc or by a large semi-circle or half ring large enough to encircle half the disc and be attached to the disc by means similar to those shown in the drawings.

While certain features of this invention have been described in detail with respect to various embodiments thereof, it will of course be apparent that other modifications can be made within the spirit and scope of this invention, and it is not intended to limit the invention to the exact details insofar as they are defined in the following claims.

The invention claimed is:

1. Exercise apparatus comprising:

(a) a board having a length substantially longer than its width and having a longitudinal groove or slot in the central portion thereof; said board having a pad at one end thereof for a user to sit on;

(b) a supporting means positioned substantially at the padded end of said board and said support means being adapted to maintain the board in a slanted position at an angle of 30°-60° with respect to a horizontal base on which said board is positioned;

(c) a weighted disc positioned on said board and having a pin projecting from the underside of said disc, said pin being positioned in said groove or slot; and (d) arm means attached to the disc for permitting a force to be applied to the disc, said arm means including two arms which extend from said disc and being pivotable toward the raised end of said board where said arm means is gripped by a user.

2. The apparatus of claim 1, in which said supporting means is of adjustable length thereby to permit adjustment of the angle of said board relative to a horizontal base.

3. The apparatus of claim 1, in which said arms have handles attached thereto at the ends thereof and extends toward the raised end of said board.

4. The apparatus of claim 1, in which said board is covered with a material which reduces the friction between said board and said weighted disc whereby said disc more easily slides down lengthwise on said board when released.

5. The apparatus of claim 4, in which said material is carpeting.

* * * * *